United States Patent [19]

Kajiyama et al.

[11] 4,389,631

[45] Jun. 21, 1983

[54] ELEVATOR POSITION DETECTING DEVICE

[75] Inventors: Ryuichi Kajiyama; Shigemi Iwata, both of Aichi, Japan

[73] Assignee: Mitsubishi Denki Kabushiki Kaisha, Tokyo, Japan

[21] Appl. No.: 221,749

[22] Filed: Dec. 31, 1980

[30] Foreign Application Priority Data

Jan. 7, 1980 [JP] Japan ..... 55-454

[51] Int. Cl.[3] ..... B66B 3/02

[52] U.S. Cl. ..... 340/21; 187/29 R

[58] Field of Search ..... 340/21; 187/29 R

[56] References Cited

U.S. PATENT DOCUMENTS

| | | | |
|---|---|---|---|
| 3,149,305 | 9/1964 | Glaser et al. | 340/21 |
| 3,967,700 | 7/1976 | Tur et al. | 340/21 X |
| 4,108,282 | 8/1978 | Satoh et al. | 187/29 R |
| 4,141,435 | 2/1979 | Satoh | 187/29 R |

FOREIGN PATENT DOCUMENTS

| | | | |
|---|---|---|---|
| 52-37349 | 3/1977 | Japan | 340/21 |

*Primary Examiner*—David L. Trafton

*Attorney, Agent, or Firm*—Sughrue, Mion, Zinn, Macpeak and Seas

[57] ABSTRACT

An elevator position detecting device which provides a correct floor position output signal even if the elevator case is moved irregularly between floors. In a first embodiment, a single cam is provided between each two adjacent floors and a single detector attached to the elevator cage produces an output signal to an electronic calculator each time the detector meets the engaging cam for upward member and leaves the cam for downward movement. A digital value corresponding to one floor is added to or subtracted from, respectively, a floor memory of the electronic calculator. In a second embodiment, two cams are provided between each two adjacent floors with each of the two cams being a fixed distance away from its adjacent floor. Two detecting means are provided on the elevator cage in this case and the content of the floor memory is divided by two to provide a correct cage position signal.

8 Claims, 7 Drawing Figures

ELEVATOR POSITION DETECTING DEVICE

BACKGROUND OF THE INVENTION

The present invention relates to an improved elevator cage position detecting device.

In operating an elevator, detection of the position of the cage is an essential function which is carried out by a floor selector. A variety of floor selectors are available. Recently, an elevator position detecting device utilizing an electronic computer as shown in FIG. 1 has been employed. In FIG. 1, reference numerals 1 and 2 designate the first floor and the second floor, respectively, 3 an engaging cam member disposed between the first floor 1 and the second floor 2 in the elevator cage passage, 4 the cage of the elevator, 5 a position-between-floors detector, 6 a converter for converting an input into data in suitable form for an electronic computer, 7 the electronic computer, and 8 a floor memory for storing cage positions which are calculated by the electronic computer 7. Data can be written into or read out of the floor memory 8.

The converter 6 is provided to convert an input signal to an information signal for electronic computer microprocessor. The converter 6 (FIG. 7) includes a plurality of sections *6a, 6b, . . . , 6n* each having resistors 61 and 62 and a photocoupler 63. The blocks *6a, 6b, . . .* produce logic level signals (***6a*-1), (*6b*-1) in response to the ON-OFF states at terminals 64, 65, . . . ,** respectively. $V_1$ and $V_2$ designate power source voltages.

In the device shown in FIG. 1, the electronic computer is Model 8085A manufactured by Intel Co. although it may, for instance, be replaced by Model M6800 manufactured by Motorola Co. or Model Z80A manufactured by Zilog Co. or a digital computer such as a microcomputer. The electronic computer 7, which is a microcomputer in this device, includes an input port 71 (Intel Co. Model 8212), a central processing unit (CPU) 72 (Intel Co. Model 8085A), an interruption period controlling timer 73 (Intel Co. 8155), a read-only memory (ROM) 74 (Intel Co. 2716), a random access memory (RAM) 75 (Intel Co. 2114A), and an output port 76 (Intel Co. 8212). The floor memory 8 may be the same random access memory (RAM) type (Intel Co. 2114A) also.

When the cage 4 is at the first floor 1, the content of the floor memory 8 is a value representative of the first floor 1. While the cage is moving upwardly, the detector 5 engages the cam 3 generating an output. The output is applied to the converter 6, the output of which is applied to the central processing unit 72 through its input port 71. In the central processing unit 72 a value of "1" is added to the content of the floor memory 8 in accordance with the output of the detector 5 and the directions of run of the cage 4. That is, the content of the floor memory 8 is changed to a value corresponding to the second floor. In the case where the cage 4 moves downwardly from the second floor 2, the detector 5 engages the cam 3 again, as a result of which "1" is subtracted from the content of the floor memory 8. That is, the content of the floor memory 8 is changed to the value corresponding to the first floor.

Thus, the calculated cage position (hereinafter referred to as "a cage position signal" when applicable) changes in synchronization with the actual cage position. Usually, the detector 5 is maintained engaged with the cam 3 for a certain period of time. Generally, the central processing unit 72 decides that the detector 5 has engaged the cam 3 either when the output of the detector changes from "open" to "closed" or when the output changes from "closed" to "open" at the instant the detector 5 engages the cam 3 so that only at that time is data received and supplied for calculation.

If, during elevator inspection operation, the cage vibrates near the cam 3, the direction of movement of the cage 4 may be reversed with the detector 5 maintained engaged with the cam 3. If, in this case, the cage is moving upwardly to cause the detector 5 to engage the cam 3, then "1" is added to the content of the floor memory 8 at the time instant when the detector 5 engages the cam 3. If the cage is continuously moved upwardly to allow the detector 5 to disengage from the cam 3 and is then moved downwardly, "1" is subtracted from the content of the floor memory 8 when the detector 5 engages the cam 3 again. However, if the direction of movement of the cage is reversed with the detector 5 maintained engaged with the cam, then the aforementioned subtraction is not carried out as a result of which the cage position signal is different from the actual cage position by as much as one floor.

Accordingly, an object of this invention is to provide an elevator position detecting device in which the above-described difficulty accompanying a conventional elevator position detecting device has been eliminated. Specifically, it is an object of the invention to provide a position detecting device in which, even if the cage is irregularly moved between floors, the cage position signal will always coincide with the actual cage position.

SUMMARY OF THE INVENTION

In accordance with this and other objects of the invention, there is provided an elevator position detecting device including a position-between-floors detector provided on an elevator cage, an engaging member for the detector disposed between floors, and electronic calculating means having inputs coupled to outputs of the detector and operating in response thereto. The electronic calculating means is programmed such that a digital value corresponding to one floor is added or subtracted from a floor memory of the calculating means to detect the position of the cage thereby to provide a cage position signal. During upward movement of the cage, a digital value corresponding to one floor is added to the floor memory whenever the detector one of meets and leaves each of the engaging members, while during downward movement of the cage, the digital value corresponding to one floor is subtracted wherever the detector does the other one of meets and leaves the engaging members.

In another preferred embodiment of the invention, there is provided an elevator position detecting device including a plurality of sets of first and second engaging members with one set of the engaging members being disposed between each two adjacent floors. First and second position detecting means are provided on an elevator cage. The outputs of the position detecting means are coupled to inputs of an electronic calculating means. The electronic calculating means is programmed such that during upward movement of the cage, a digital value corresponding to one floor is added to a floor memory of the calculating means whenever the first detecting means one of meets and leaves each of the first engaging members while during downward movement of the cage, the digital value corresponding to one floor is subtracted whenever the first detecting means the other of meets and leaves each of the first engaging members. Also, during upward movement of the cage, the digital value corresponding to one floor is added whenever the second detecting means one of meets and leaves each of the second engaging members while during downward movement of the cage, the digital value corresponding to one floor is subtracted whenever the second detecting means the other of meets and leaves each second engaging member. When the content of the floor memory is changed in response to the first position detecting means, a cage position signal is produced having a value obtained by dividing the sum of the content of the floor memory and the digital value corresponding to one floor by two, and when the content of the floor memory is changed in response to the second detecting means, the cage position signal has a value obtained by dividing only the content of the floor memory by two.

DESCRIPTION OF THE PREFERRED EMBODIMENTS

Figure 1:
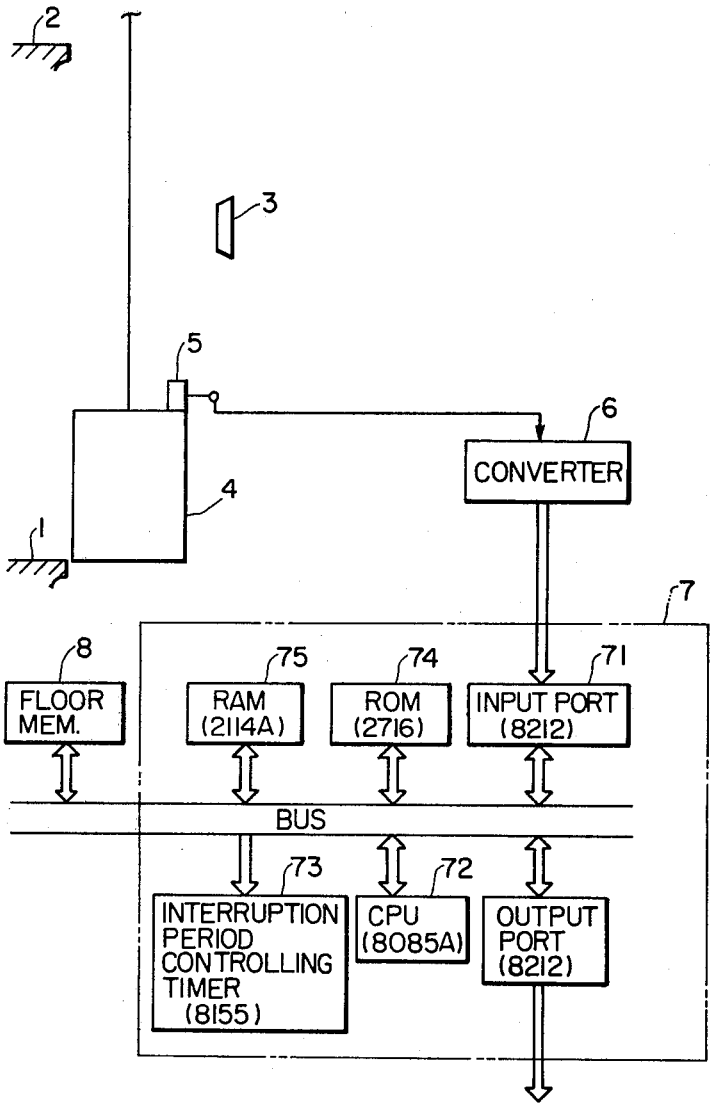
FIG. 1 PRIOR ART
FIG. 1 is an explanatory diagram showing the arrangement of a conventional elevator position detecting device.

A preferred embodiment of the invention will be described with reference to FIGS. 1 through 3.

Figure 2:
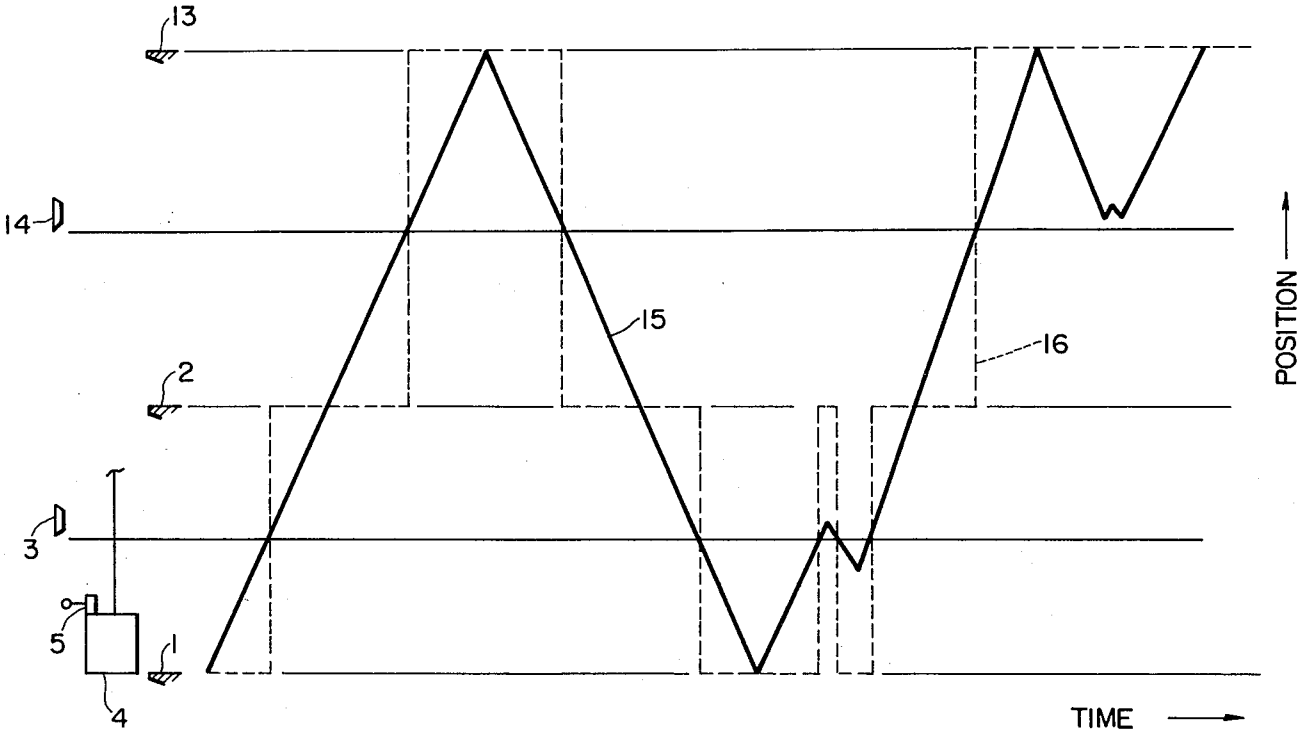
FIG. 2 is a diagram for a description of the arrangement and the operation of a first preferred embodiment of an elevator position detecting device according to the invention.
Figure 3:
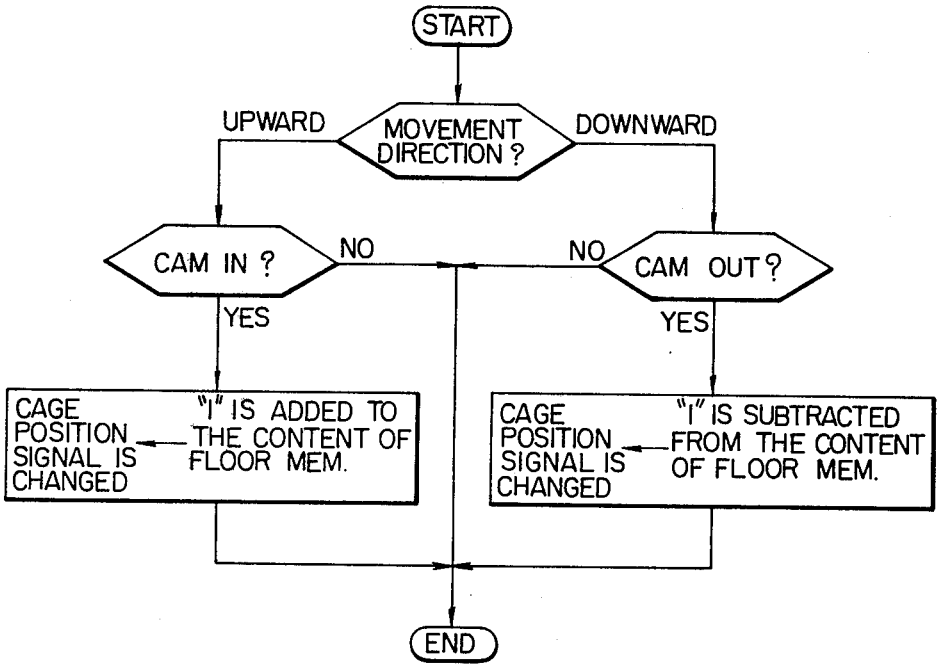
FIG. 3 is a diagram showing the flow chart of a program which is stored in a read-only memory of an electronic computer employed in detecting device of FIG. 5.

In FIG. 2, reference numeral 13 designates the third floor, 14 a cam disposed between the second floor 2 and the third floor 13, 15 and the line of movement of the cage 4, and 16 the cage position signal. The remaining reference numerals are the same as used in FIG. 1 and designate like components.

The operation of the preferred embodiment will be described. When the cage 4 is at the first floor 1, a binary number "0001" corresponding to one (1) in decimal notation, and referred to merely as "1" for simplification in description, is stored in the floor memory 8. As the cage 4 moves upwardly, the detector 5 engages the cam 3 as a result of which the state of the detector 4 is changed from "open" to "closed" (or from "closed" to "open"). This operation is referred to as "meeting" hereinafter when applicable. The output of the detector 5 is applied through the converter 6 to the input port 71 of the electronic computer 7 and is then operated upon by the central processing unit 72 according to a program which is stored in the read-only memory 74 as a result of which "1" is added to the content of the floor memory 8. That is, the cage position signal 16 is changed to "2". As the cage is further moved upwardly, the detector 5 engages another cam 14 between the second floor and the third floor. As a result, as in the above-described case, calculation is performed by the electronic computer 7 so that "1" is added to the content of the floor memory 8 and the cage position signal is changed to "3". A flow chart of the program for operating the central processing unit 72 is shown in FIG. 3.

While the cage 4 is moving downwardly from the third floor 13, the state of the detector 5 is changed from "closed" to "open" (or from "open" to "closed") when, after first meeting the cam 14, the detector 5 leaves the cam 14. This operation is referred to as "leaving" hereinafter when applicable. The output signal of the detector 5 is operated upon by the electronic computer 7 as in the above-described case as a result of which "1" is subtracted from the content "3" of the floor memory 8 and the cage position signal is changed to "2".

When the cage 4 moves upwardly from the first floor 1, the detector 5 meets the cam 3 and the direction of movement of the cage 3 is reversed with the detector 5 maintained engaged with the cam 3. In this case, the cage position signal is changed to "2" by the above-described meeting operation. When the cage 4 is moved downwardly causing the detector 5 to leave the cam 3, the cage position signal 16 is changed to "1". When the cage 4 moves downwardly from the second floor 2, the detector 5 meets the cam 3 and the direction of movement of the cage is reversed with the detector 5 maintained engaged with the cam 3. When the detector 5 meets the cam 3, the cage 4 is moving downwardly and the detector 5 does not immediately leave from the cam 3 and therefore the cage position signal remains "2". If the direction of movement of the cage 4 is reversed so that the cage 4 is moved upwardly, the detector 5 leaves the cam 3 but the cage position signal 16 remains at "2" because of the upward movement of the cage.

As is apparent from above description, even if the direction of movement of the cage is reversed before the detector 5 leaves the cam 3 during the upward movement and the direction of movement of the cage 4 thus reversed is again reversed before the detector 5 leaves the cam 3, that is, even if the direction of movement of the cage 4 is repeatedly reversed with the detector 5 maintained engaged with the cam 3 or 14, the cage position signal 16 is maintained unchanged. Thus, even if the cage 14 is irregularly moved between adjacent floors, the cage position signal 16 coincides with the actual cage position.

Another embodiment of the invention will be described with reference to FIGS. 4 through 6.

The cage position signal 16 is used for calling-signal detection and deceleration instruction. Therefore, it is desirable for control that the cage position signal be changed when the cage is at a predetermined distance from a floor. In the first embodiment described above, even if the cam 3 or 14 is provided at the center of the distance between adjacent floors, the distances between the cams and the relevant floors are not equal if the distances between adjacent floors are not equal. Accordingly, in this case, the cage position signal 16 is not changed at the same distance from every floor. This difficulty has been eliminated by the second embodiment of the invention shown in FIGS. 4 through 6.

Figure 4:
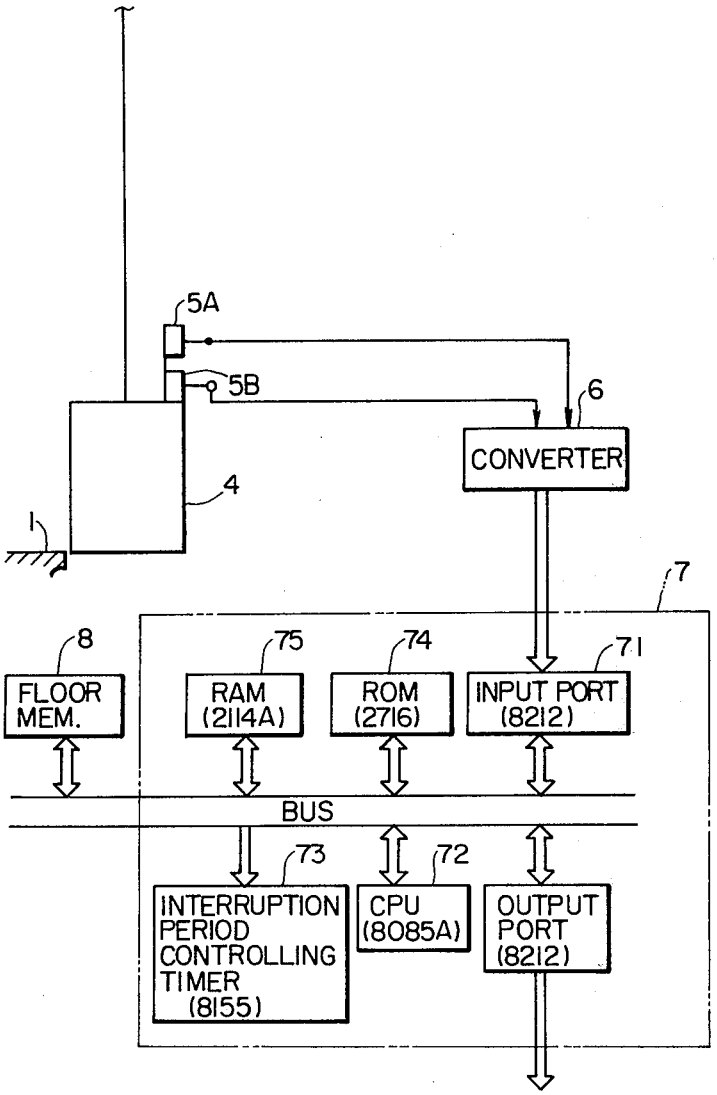
FIG. 4 is an explanatory diagram showing the arrangement of a second preferred embodiment of an elevator position detecting device according to the invention.
Figure 5:
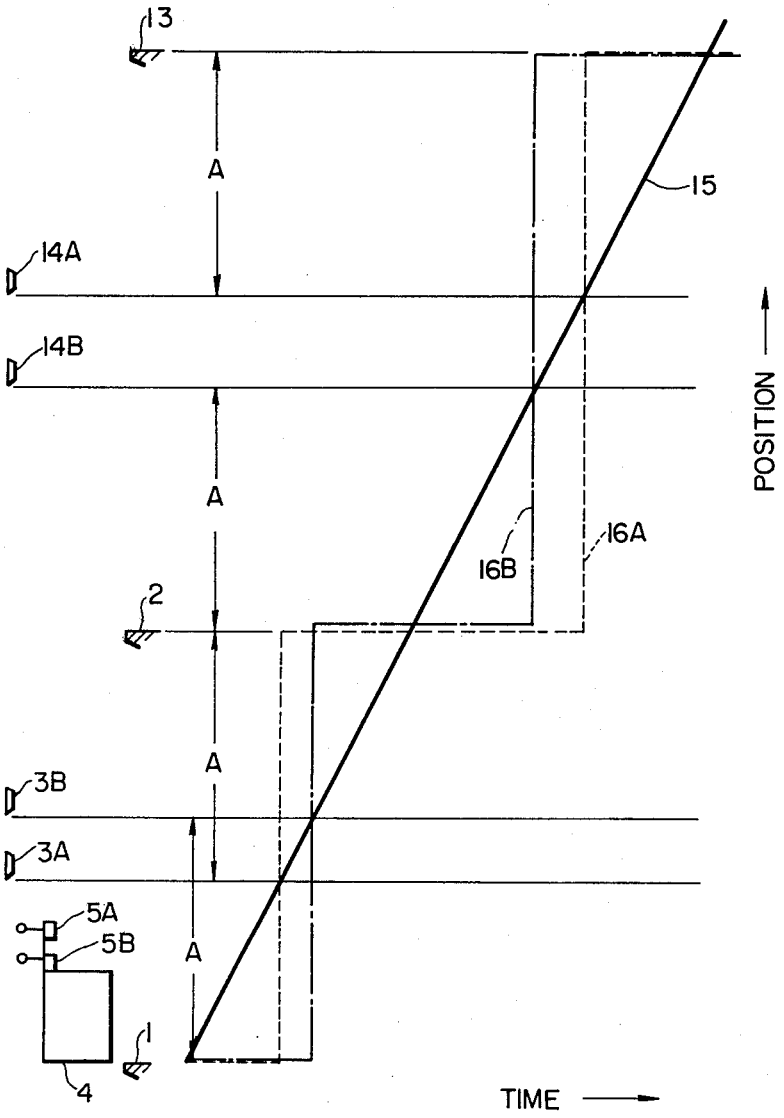
FIG. 5 is a diagram for a description of the operation of the device shown in FIG. 4.
Figure 6:
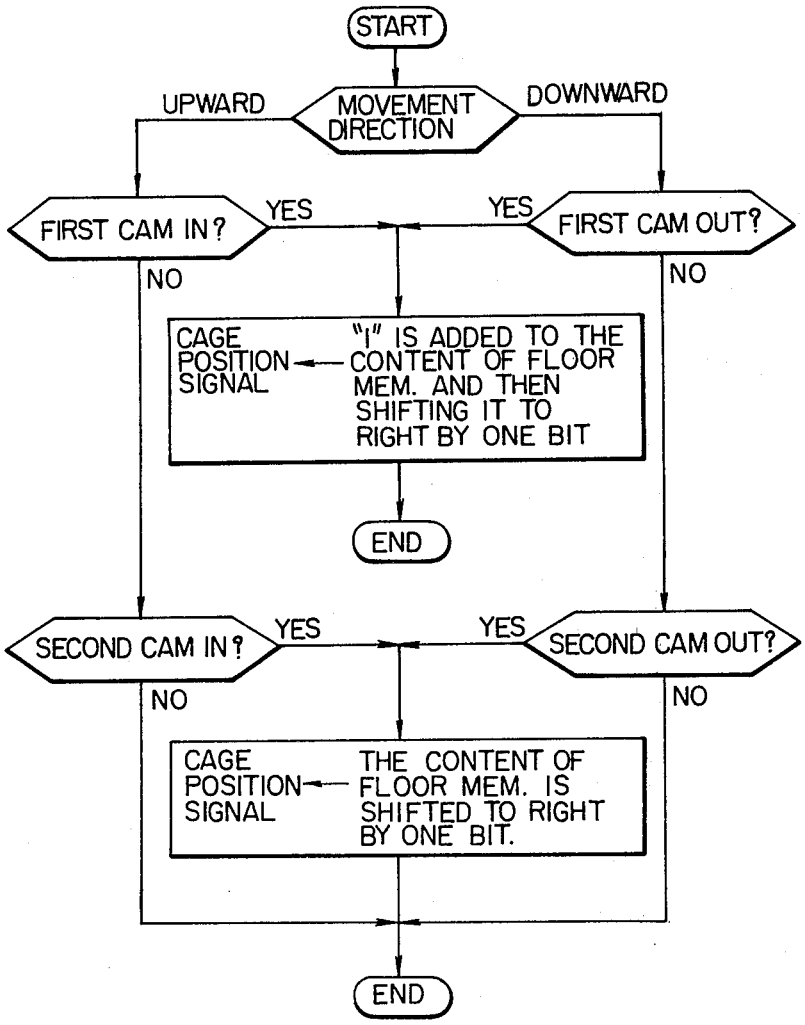
FIG. 6 is a diagram showing the flow chart of a program which is employed for the device shown in FIG. 4.
Figure 7:
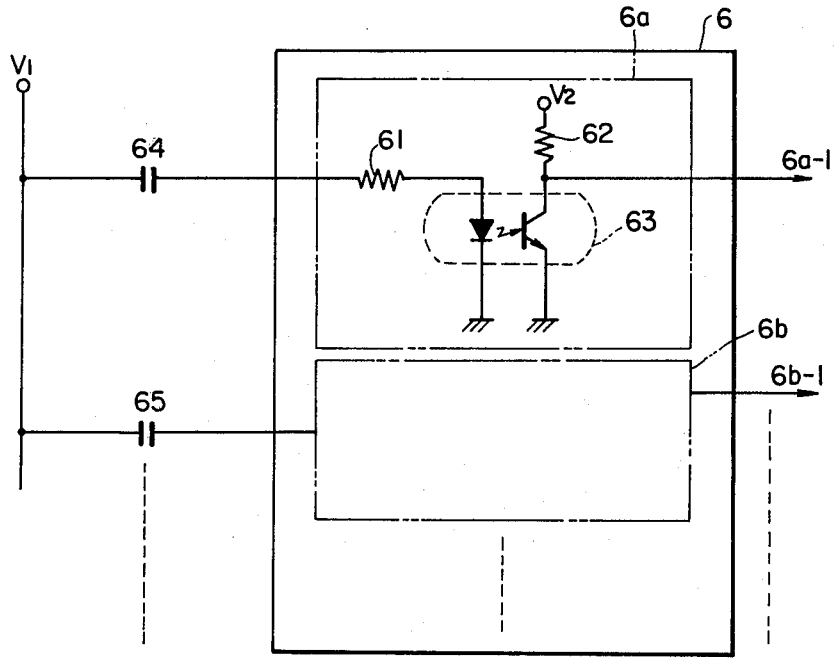
FIG. 7 is a diagram showing the internal circuit of the converter 6 in FIGS. 1 and 4.

In FIGS. 4 through 6, reference characters 3A and 14A designate first cams which are disposed at a predetermined distance A downwardly from the second floor 2 and the third floor 13, respectively; 3B and 14B second cams which are provided at the predetermined distance A upwardly from the first floor 1 and the second floor 2, respectively; 5A a first position-between-floor detector which is provided on the cage 4 for engaging with the first cams 3A and 14A and which is hereinafter referred to as a first detector 5A when applicable; 5B a second position-between-floors detector for engaging with the second cams 3B and 14B, hereinafter referred to as "a second detector 5B" when applicable; 16A a cage position signal for upward cage movement; and 16B a cage position signal for downward cage movement. The remaining reference characters are the same as those in FIGS. 1 and 2, except for reference characters 3 and 5, and designate like components.

The operation of the second embodiment will be described. When the cage 4 is at the first floor 1, "2" is stored in the floor memory 8. As the cage is moved upwardly, the first detector 5A meets the cam 3A and an output signal is accordingly produced. The output signal is applied through the converter 6 to the input port 71 of the electronic computer 7 and is then operated upon by the central processing unit 72 according to a program stored in the read-only memory 74 the flow chart of which is as shown in FIG. 6. As a result, "1" is added to the content of the floor memory 8, that is, the content of the floor memory 8 is changed to "3". As the cage 4 is moved further upwardly, the second detector 5B engages the second cam 3B to produce an output signal. As in the above-described case, the output signal is operated upon by the electronic computer 7 as a result of which "1" is added to the content of the floor memory 8, that is, the content of the floor memory 8 is changed to "4". Similarly, when the second detector 5B meets the second cam 14B after the cage 4 has passed through the second floor 2, the content of the floor memory 8 is changed to "5", and when the first detector 5A meets the first cam 14A, the content of the floor memory 8 is changed to "6".

The case where the cage 4 is moved downwardly from the third floor 3 will be described. When the first detector 5A leaves the first cam 14A, the first detector 5A produces an output signal. Similarly, the output signal is operated upon by the electronic computer 7 as a result of which "1" is subtracted from the content "6" of the floor memory 8. That is, the content of the floor memory 8 is changed to "5". When the cage 4 is moved further downwardly causing the second detector 5B to leave the cam 14B, the output signal of the second detector is similarly operated upon by the electronic computer 7. As a result, "1" is subtracted from the content of the floor memory 8, that is, the content of the floor memory 8 is changed to "4". When the second detector 5B leaves the second cam 3B after the cage has passed through the second floor 2, the content of the floor memory 8 is changed to "3", and when the first detector 5A leaves the first cam 3A, the content of the floor memory 8 is changed to "2".

The calculation operations of the electronic computer in the case of the cage upward movement will be described with reference to FIG. 6.

When the cage 4 is at the first floor 1, the content of the floor memory 8 is "2" while the cage position signal 16A is "1". When the first detector 5A meets the first cam 3A after the cage 4 has been moved upwardly, the content of the floor memory 8 is changed to "3", and a value equal to the content of the floor memory 8+"1" divided by "2" is calculated, in decimal notation, as a result of which the cage position signal 16A is "2". When the second detector 5B meets the second cam 3B, the content of the floor memory 8 is changed to "4", and a value equal to the content of the floor memory 8 divided by "2" is calculated as a result of which the cage position signal 16A is "2". As the cage 4 is further moved upwardly, the second detector 5B meets the second cam 14B whereupon the content of the floor memory 8 is changed to "5" and the cage position signal 16A is "2" which is the content of the floor memory divided by "2". When the first detector 5A meets the first cam 14A, the content of the floor memory 8 is changed to "6" and the cage position signal 16A is "3", which is the content of the floor memory 8+"1" with the sum divided by "2".

As described above, during the upward movement of the cage, the cage position signal 16A is as indicated in FIG. 5. That is, it changes when the cage is at the predetermined distance downwardly from each floor. Similarly, for downward movement of the cage, the cage position signal 16B is changed when the cage is at the predetermined distance upwardly from each floor.

If the cams 3A and 14A in FIG. 5 are disposed at the upward movement deceleration preparation points for the second floor 2 and the third floor 13, respectively, and the cams 3B and 14B are disposed at the downward movement deceleration preparation points for the first floor 1 and the second floor 2, respectively, then they can be used as deceleration preparation point detecting cams (not shown) also, which contributes to a reduction of the cost of the elevator system.

In the above-described embodiment, during upward movement of the cage, "one floor" is added whenever the detector meets the cam while for downward movement of the cage, "one floor" is subtracted whenever the detector leaves the cam. The same effect can be obtained by varying the described arrangement in such a manner that during upward cage movement "one floor" is added whenever the detector leaves the cam while during downward cage movement "one floor" is subtracted whenever the detector meets the cam.

As described above, in accordance with the invention, during upward cage movement, "one floor" is added whenever the detector meets the engaging piece while during downward cage movement, "one floor" is subtracted whenever the detector leaves the engaging piece, or alternatively, during upward cage movement, "one floor" is added whenever the detector leaves the engaging piece while during downward cage movement, "one floor" is subtracted whenever the detector meets the engaging piece. Accordingly, even if the cage is moved irregularly between floors, the cage position signal always coincides with the actual cage position.

Furthermore according to the invention, during upward cage movement, "one floor" is added whenever each of the first and second detectors meets the respective engaging piece while during cage movement downward "one floor" is subtracted whenever each of the first and second detectors leaves the respective engaging piece, or, alternatively, during upward cage movement, "one floor" is added whenever each of the first and second detectors leaves the respective engaging piece while during downward cage movement, "one floor" is subtracted whenever each of the first and second detectors meets the respective engaging piece.

When the cage position data is changed in accordance with the output of the first detector, the cage position signal has a value which is obtained by dividing the sum of the resultant data and "one floor" by "2", and when the cage position data is changed in accordance with the output of the second detector, the cage position signal has a value which is obtained by dividing the resultant data by "2". Accordingly, even if the distances between adjacent floors are different from one another, the cage position signal can be changed when the cage is the predetermined distance before each floor.

What is claimed is:

1. An elevator position detecting device comprising:

a position-between-floors detector provided on an elevator cage;

a plurality of engaging members for said detector, one of said engaging members being disposed between each two adjacent floors; and electronic calculating means having inputs coupled to outputs of said detector, said calculating means being programmed such that a digital value corresponding to one floor is added or subtracted from a floor memory of said calculating means to detect the position of said cage thereby to provide a cage position signal, wherein during movement of said cage in one direction, said digital value corresponding to one floor is added to said floor memory whenever said detector meets each said engaging member, and during movement of said cage in the other direction, said digital value corresponding to one floor is subtracted whenever said detector leaves each said engaging member.

2. An elevator position detecting device comprising:

a plurality of sets of first and second engaging members, one of said sets of engaging members being disposed between each two adjacent floors;

first and second position detecting means provided on an elevator cage; and electronic calculating means having inputs coupled to outputs of said detecting means, said electronic calculating means being programmed such that during movement of said cage in one direction, a digital value corresponding to one floor is added to a floor memory of said calculating means whenever said first detecting means meets each said first engaging member, while during movement of said cage in the other direction, said digital value corresponding to one floor is subtracted whenever said first detecting means leaves each first engaging member, and during movement of said cage in said one direction, said digital value corresponding to one floor is added whenever said second detecting means meets each said second engaging member, while during movement of said cage in said other direction, said digital value corresponding to one floor is subtracted whenever said second detecting means leaves each said second engaging member, and wherein when the content of said floor memory is changed in response to said first position detecting means, a cage position signal is produced having a value obtained by dividing the sum of said content of said floor memory plus said digital value corresponding to one floor by two, and when said content of said floor memory is changed in response to said second detecting means, said cage position signal has a value obtained by dividing said content of said floor memory by two.

3. An elevator position detecting device comprising:

a position-between-floors detector provided on an elevator cage;

a plurality of engaging members for said detector, one of said engaging members being disposed between each two adjacent floors; and electronic calculating means having inputs coupled to outputs of said detector, said calculating means being programmed such that a digital value corresponding to one floor is added or subtracted from a floor memory of said calculating means to detect the position of said cage thereby to provide a cage position signal, wherein during movement of said cage in one direction, said digital value corresponding to one floor is added to said floor memory whenever said detector leaves each said engaging member, and during movement of said cage in the other direction, said digital value corresponding to one floor is subtracted whenever said detector meets each said engaging member.

4. An elevator position detecting device comprising:

a plurality of sets of first and second engaging members, one of said sets of engaging members being disposed between each two adjacent floors;

first and second position detecting means provided on an elevator cage; and electronic calculating means having inputs coupled to outputs of said detecting means, said electronic calculating means being programmed such that during movement of said cage in one direction, a digital value corresponding to one floor is added to a floor memory of said calculating means whenever said first detecting means leaves each said engaging member, while during movement of said cage in the other direction, said digital value corresponding to one floor is subtracted whenever said first detecting means meets each first engaging member, and during movement of said cage in said one direction, said digital value corresponding to one floor is added whenever said second Gobtained by dividing the sum of said content of said floor memory plus said digital value corresponding to one floor by two, and when said content of said floor memory is changed in response to said second detecting means, said cage position signal has a value obtained by dividing said content of said floor memory by two.

5. The elevator position detecting device of either one of claims 2 and 4 wherein each said first engaging member is a first fixed predetermined distance from a downwardly adjacent floor and each said second engaging member is a second fixed predetermined distance from an upwardly adjacent floor.

6. The elevator position detecting device of any one of claims 1, 2, 3 and 4 wherein each of said engaging members comprises a cam.

7. The elevator position detecting device of either one of claims 1 and 3 further comprising optical coupler means for coupling outputs of said detector to said calculating means.

8. The elevator position detecting device of either one of claims 2 and 4 further comprising means for coupling outputs of said detecting means to said calculating means.

* * * * *